United States Patent [19]

McAlvage

[11] 4,261,061

[45] Apr. 14, 1981

[54] PROCESS OF TREATING ATHLETIC SOCKS TO PREVENT SHOE IRRITATION OR BLISTERS OF THE FEET, AND PRODUCT

[76] Inventor: Edward M. McAlvage, 2008 Fairview Ave., Grants Pass, Oreg. 97526

[21] Appl. No.: 44,526

[22] Filed: Jun. 1, 1979

[51] Int. Cl.[3] ..... A41B 11/00

[52] U.S. Cl. ..... 2/239

[58] Field of Search ..... 12/239, 241, 409

[56] References Cited

U.S. PATENT DOCUMENTS

| | | | |
|---|---|---|---|
| 163,209 | 5/1875 | Kent | 2/239 |
| 174,339 | 2/1876 | Wakeman | 2/239 |
| 294,020 | 2/1884 | Eisendrath | 2/239 X |
| 4,034,580 | 7/1977 | Holder | 2/239 X |
| 4,104,892 | 8/1978 | Thorneburg | 2/239 |

*Primary Examiner*—H. Hampton Hunter

*Attorney, Agent, or Firm*—Eugene M. Eckelman

[57] ABSTRACT

Athletic type socks worn by persons in sports or other active people are provided with an exterior coating of a mild lubricant. This provides slippage between the socks and the shoes and prevents friction between the socks and the feet. Such eliminates irritation and blisters to the feet during activity.

7 Claims, 3 Drawing Figures

PROCESS OF TREATING ATHLETIC SOCKS TO PREVENT SHOE IRRITATION OR BLISTERS OF THE FEET, AND PRODUCT

BACKGROUND OF THE INVENTION

This invention relates to a new and useful improvement relating to the treatment of athletic type socks so as to prevent irritation and blisters of the feet.

It is a well known fact that active persons frequently have foot irritations from shoes when engaged in athletics or other activities, particularly in initial or training portions of sport programs. This irritation of the feet is primarily caused by the relative movement of the foot within the sock in that such relative movement causes friction which usually results in discomfort and irritation and even incapacitating blisters. Many medications have been provided to treat irritated feet but such medications are only intended to give relief to the damage already done to feet rather than providing a preventative to the actual source of the trouble.

SUMMARY OF THE INVENTION

According to the present invention and forming a primary objective thereof, a process and product are provided to prevent shoe irritation and blisters of the feet from a rubbing of the sock against the feet.

According to the invention, a mild lubricant is applied to the exterior of athletic type socks in the shoe-receiving portion thereof. The lubricant provides slippage between the socks and the shoes and eliminates or substantially reduces relative movement between the socks and the feet. The lubricant, which may for example comprise a soap of a fatty acid composition is applied on the socks by hand or placed in a container and the person wearing the socks can step into the container and scuff his feet.

The invention will be better understood and additional objects and advantages will become apparent from the following description taken in connection with the accompanying drawings.

DETAILED DESCRIPTION OF PREFERRED EMBODIMENTS

Figure 3:
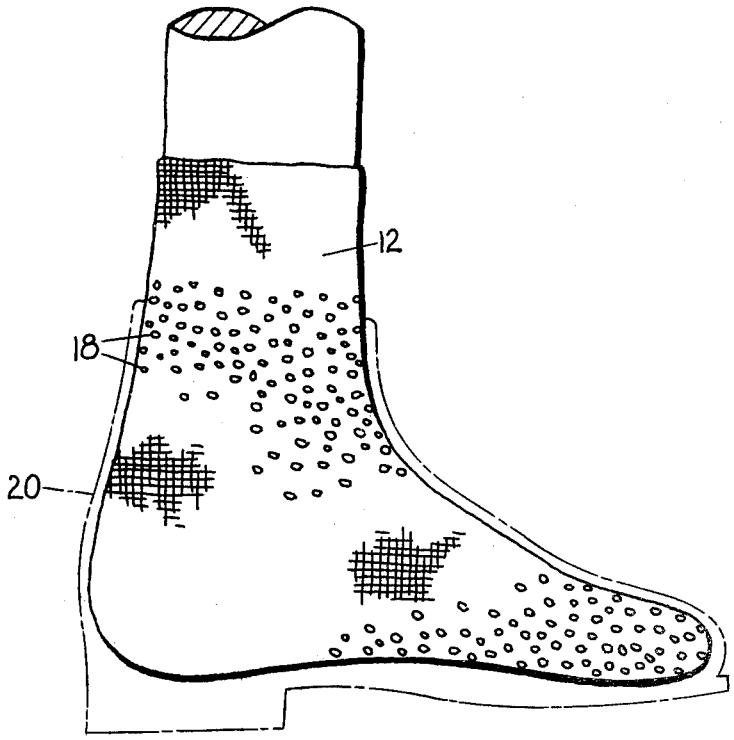
FIG. 3 is an elevational view of an athletic sock as worn by a person and provided with a coating of lubricant according to the invention, a shoe worn on the foot being shown in broken lines.
Figure 1:
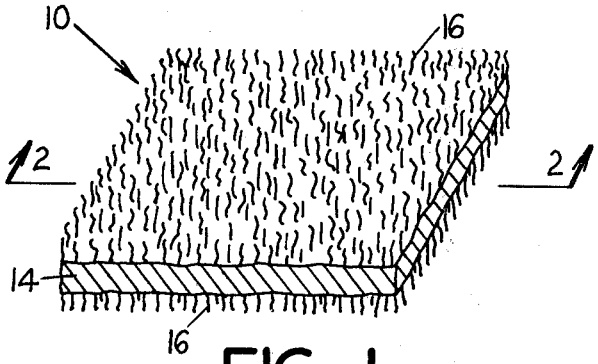
FIG. 1 is a fragmentary perspective view of a piece of fabric from which athletic socks of conventional use are made and which makes possible the functioning of the instant invention.
Figure 2:
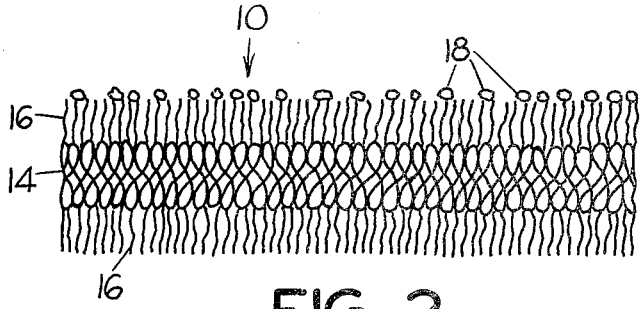
FIG. 2 is an enlarged sectional view taken on the line 2—2 of FIG. 1 and further showing application of the instant invention.

With particular reference to the drawings, the present invention finds efficient application to athletic type socks which are in common use. As best seen in FIGS. 1 and 2, the fabric 10 from which such socks 12, FIG. 3, are constructed has a substantially heavy body or knitted portion 14 and a pile or nap 16 on each surface. This thick fabric provides the cushioning, absorption, etc. desired in athletic type socks and contributes to the invention as will now be apparent.

According to the invention and as seen in FIG. 3, the exterior surface of the athletic type sock 12 is coated with a mild lubricant 18 in those areas that may be engaged with the shoe 20 when worn. Such coating will generally be applied over the entire sock that will be disposed in the shoe. The particular construction of the athletic type sock with the heavy body portion and pile functions efficiently for the present purpose since the lubricant will adhere to the pile on the exterior surface and will not penetrate the sock to the inside, the pile acting as hooks to hold the lubricant on the exterior surface for easy application and efficient functioning.

It is preferred to use a lubricant that will be softened by body heat so as to provide a slippery surface between the sock and the shoe almost immediately after the shoe is put on. As such lubricant is softened, it will penetrate the exterior pile and engage the body portion 14 of the sock but in view of the heavy body portion of the sock it will not pass through it to the foot side. In FIG. 2, the lubricant 18 is shown just after it was applied, namely, before it has softened and melted into the pile portion of the sock. As stated, however, as the lubricant is heated from body temperature and activity, and perspiration as well, it will penetrate the pile more and adhere effectively to the sock.

With the lubricant in place as described, the inherent lubricating qualities thereof provides a slippery surface between the shoes and the socks. The feet thus will not have any material relative movement with the socks. Since primarily all of the relative movement of the feet, socks and shoes will result between the socks and the shoes, no appreciable irritation will occur to the feet.

An effective lubricant for the present purpose is a conventional sodium or potassium soap, namely, any soap that is made with fatty acid. Such soap provides the desired lubrication and also is not toxic to the skin. The soap can be applied in liquid or paste form in any suitable manner, it can be applied by the aerosol method, or it can be dusted on in particle or flake form. Soap flakes are especially good since manufacturing processes thereof mostly seek to provide thin, fluffy-like flakes or small porous granules that make them highly soluble in water. This structure makes the flakes soften almost immediately by body heat to produce good lubrication. In addition, since they are curved, jagged, wavy, round, or of other shapes, they adhere efficiently to the pile of the sock for ease of application.

Other lubricants can be used as well, for example, lubricating jelly such as used in gynecology and surgery, it only being required that such lubricant have an overall composition that allows it to adhere to the exterior of an athletic type sock without completely penetrating the sock and also that it is not toxic to the skin.

The lubricant can be sprayed, rubbed or dusted on the exterior of the socks, or, with the socks on the feet, the wearer can step into an open top container containing a supply of the lubricant to apply the necessary layer of lubricant.

The lubricant may have a number of additives such as perfume, deodorants, coloring or glycerides without interfering with the lubricating qualities thereof.

It is to be understood that the forms of my invention herein shown and described are to be taken as preferred examples of the same and that various changes in the shape, size and arrangement of parts or steps may be resorted to without departing from the spirit of my invention or the scope of the subjoined claims.

Having thus described my invention, I claim:

1. A process of treating socks to prevent irritation of the feet in shoes worn thereon, said socks being of the type which are formed from a fabric having a knitted body portion and projecting pile on opposite sides thereof comprising interior and exterior surfaces of the socks, said process comprising applying a lubricant to the exterior of the socks in the shoe-receiving portion thereof whereby such lubrication allows free relative movement of the socks and shoes to prevent relative movement between the socks and the feet, thus reducing the possibility of irritation to the feet from the socks rubbing thereagainst.

2. The process of claim 1 wherein said lubricant is sprayed on said exterior pile as a liquid.

3. The process of claim 1 wherein said lubricant is in particle form and is dusted on said exterior pile.

4. The process of claim 1 including the step of placing said lubricant in an open top container and then stepping in such container while wearing the sock.

5. A treated sock to prevent irritation of the foot in a shoe worn thereon, said sock being of the type which is formed from a fabric having a knitted body portion and projecting pile on opposite sides thereof comprising interior and exterior surfaces of the sock, and a lubricant on the exterior pile of the sock to allow free relative movement of the sock and a shoe to prevent relative movement between the sock and the foot, thus reducing the possibility of irritation to the foot from the sock rubbing thereagainst.

6. A process of treating socks to prevent irritation of the feet in shoes worn thereon, said socks being of the type which are formed from a fabric having a knitted body portion and projecting pile on opposite sides thereof comprising interior and exterior surfaces of the socks, said process comprising applying a soap having a fatty acid composition to the exterior of the socks in the shoe-receiving portion thereof whereby such soap allows free relative movement of the socks and shoes to prevent relative movement between the socks and the feet, thus reducing the possibility of irritation to the feet from the socks rubbing thereagainst.

7. A process of treating socks to prevent irritation of the feet in shoes worn thereon, said socks being of the type which are formed from a fabric having a knitted body portion and projecting pile on opposite sides thereof comprising interior and exterior surfaces of the socks, said process comprising applying a lubricating jelly to the exterior of the socks in the shoe-receiving portion thereof whereby such lubricating jelly allows free relative movement of the socks and shoes to prevent relative movement between the socks and the feet, thus reducing the possibility of irritation to the feet from the socks rubbing thereagainst.

* * * * *